US010544942B2

(12) United States Patent
Clemen et al.

(10) Patent No.: US 10,544,942 B2
(45) Date of Patent: Jan. 28, 2020

(54) METHOD FOR MOUNTING A COMBUSTION CHAMBER OF A GAS TURBINE ENGINE

(71) Applicant: Rolls Royce Deutschland Ltd & Co KG, Blankenfelde-Mahlow (DE)

(72) Inventors: Carsten Clemen, Mittenwalde (DE); Kay Heinze, Ludwigsfelde (DE); Volker Herzog, Zeuthen (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 364 days.

(21) Appl. No.: 15/374,449

(22) Filed: Dec. 9, 2016

(65) Prior Publication Data

US 2017/0167731 A1 Jun. 15, 2017

(30) Foreign Application Priority Data

Dec. 11, 2015 (DE) ..... 10 2015 224 990

(51) Int. Cl.
*F23R 3/60* (2006.01)
*F23R 3/50* (2006.01)

(52) U.S. Cl.
CPC ..... *F23R 3/60* (2013.01); *F05D 2260/31* (2013.01); *F05D 2300/10* (2013.01); *F23R 3/50* (2013.01); *F23R 2900/00017* (2013.01)

(58) Field of Classification Search
CPC . B23P 15/008; F02K 9/62; F23R 2900/00017
See application file for complete search history.

(56) References Cited

U.S. PATENT DOCUMENTS 5,524,430 A 6/1996 Mazeaud et al.
5,934,066 A 8/1999 Schmid et al.
(Continued)

FOREIGN PATENT DOCUMENTS

DE 19643028 4/1998
EP 1251312 10/2002
FR 2965604 A1 * 4/2012 ..... F23R 3/002

OTHER PUBLICATIONS

European Search Report dated May 11, 2017 for counterpart European Application No. 16202400.4.
(Continued)

*Primary Examiner* — Todd E Manahan
*Assistant Examiner* — Todd N Jordan
(74) *Attorney, Agent, or Firm* — Shuttleworth & Ingersoll, PLC; Timothy Klima

(57) ABSTRACT

A method for mounting a combustion chamber of a gas turbine engine, wherein an annular outer combustion chamber wall and an annular inner combustion chamber wall are brought in position with respect to one another and are connected to a head plate, and wherein subsequently a combustion chamber head is mounted, characterized in that the head plate is connected to the outer combustion chamber wall and the inner combustion chamber wall by means of rivets that are arranged in a circumferentially distributed manner, and that subsequently the combustion chamber head is brought in position and is screwed together by means of threaded bolts and nuts to the arrangement of head plate, outer combustion chamber wall and inner combustion chamber wall, which is pre-mounted by means of the rivet.

9 Claims, 5 Drawing Sheets

(56) References Cited

U.S. PATENT DOCUMENTS

Figure 1:
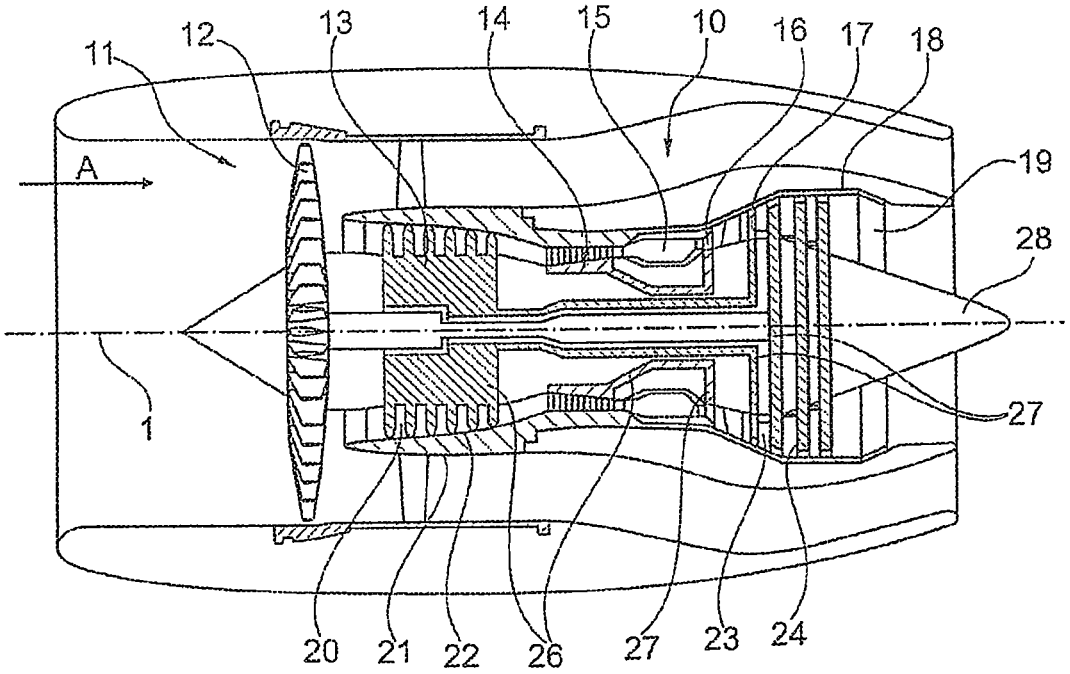

| | | | | |
|---|---|---|---|---|
| 6,449,952 | B1 * | 9/2002 | Emilianowicz | F01D 25/243 60/752 |
| 6,679,063 | B2 * | 1/2004 | Ebel | F23R 3/10 60/747 |
| 7,757,495 | B2 | 7/2010 | Bessagnet et al. | |
| 7,765,809 | B2 * | 8/2010 | Brown | F23R 3/10 60/752 |
| 2007/0074520 | A1 | 4/2007 | Biebel et al. | |
| 2008/0010997 | A1 | 1/2008 | Bessagnet et al. | |
| 2009/0229273 | A1 * | 9/2009 | Garry | F23R 3/002 60/796 |
| 2009/0293487 | A1 | 12/2009 | De Sousa et al. | |
| 2010/0095525 | A1 * | 4/2010 | Shaw | B23P 6/002 29/888.021 |
| 2012/0073306 | A1 | 3/2012 | Habarou et al. | |
| 2012/0272654 | A1 | 11/2012 | Kaleeswaran et al. | |
| 2013/0192262 | A1 * | 8/2013 | Eastwood | F23R 3/002 60/805 |
| 2014/0360196 | A1 | 12/2014 | Graves et al. | |

OTHER PUBLICATIONS

German Search Report dated Dec. 11, 2015 from counterpart German App No. 102015224990.5.

* cited by examiner

STATE OF THE ART

STATE OF THE ART

STATE OF THE ART

STATE OF THE ART

METHOD FOR MOUNTING A COMBUSTION CHAMBER OF A GAS TURBINE ENGINE

This application claims priority to German Patent Application 102015224990.5 filed Dec. 11, 2015, the entirety of which is incorporated by reference herein.

The invention relates to a method for mounting a combustion chamber of a gas turbine engine according to features disclosed herein.

Specifically, the invention relates to a method in which a combustion chamber, in particular an annular combustion chamber of a gas turbine engine, is mounted. At that, an outer and an inner annular combustion chamber wall are manufactured in the usual manner, for example from sheet metal materials. The outer and the inner combustion chamber wall can be configured with a single wall. However, it is also possible to configure them with a double wall and to provide them with shingles or similar structural components on the respective internal side.

A combustion chamber of a gas turbine engine has a head plate that is also annular and that is provided with recesses through which burners are passed. The head plate is connected to the outer and the inner combustion chamber wall, so that the basic elements of the combustion chamber can be mounted. In the following, the combustion chamber head is mounted at the head plate, the outer combustion chamber wall, or the inner combustion chamber wall.

The state of the art shows different design variants for this purpose. These are for example explained in U.S. Pat. Nos. 6,449,952 81 and 7,765,809 B2.

As shown in FIGS. 2 to 5, in the state of the art, the mounting is performed in such a manner that first an outer annular combustion chamber wall 29 and an inner annular combustion chamber wall 30 are provided, with both being configured as sheet metal parts. At the inflow-side end, a head plate 31 is arranged that is preferably also made of sheet metal.

The outer combustion chamber wall 29 has an outer flange 41, while the inner combustion chamber wall 30 is provided with an inner flange 42. The flanges are arranged at an angle to the longitudinal extension of the outer or the inner combustion chamber wall 29, 30 so as to be aligned in parallel to the engine axis 1. According to the invention, the angle between the outer flange 41 and the outer combustion chamber wall 29 or the inner flange 42 and the inner combustion chamber 30 is not necessary.

Figure 2:
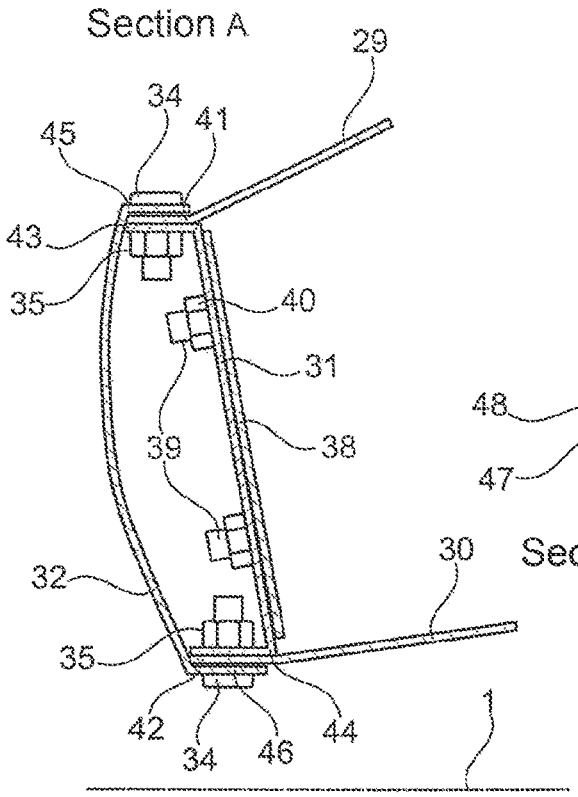
Figure 3:
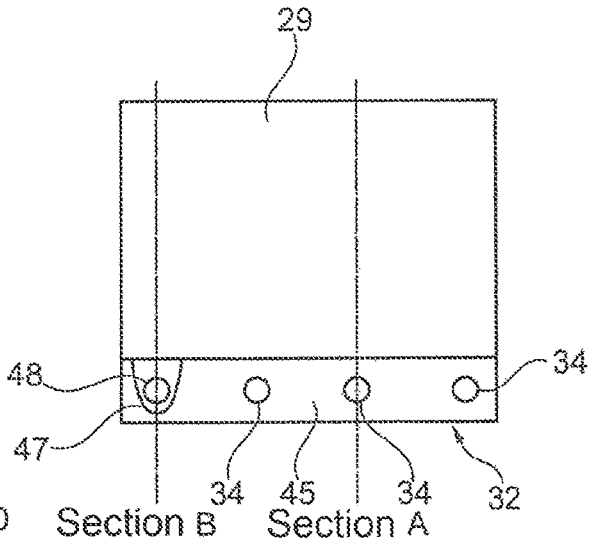

FIG. 3 shows a top view onto a partial area of a completely mounted combustion chamber according to the state of the art. In FIG. 2, a sectional view according to section A is shown. As can be seen here, the head plate 31 is provided with an outer flange 43 and an inner flange 44. In the mounted state, these two flanges 43 and 44 extend in parallel to the flanges 41 and 42 of the outer or the inner combustion chamber wall.

Further, FIG. 2 shows a combustion chamber head 32 that is preferably made of a sheet metal material and that is provided with an outer flange 45 and an inner flange 46. In the mounted state, the flanges are aligned in parallel to the flanges 41 to 44, and are screwed on by means of threaded bolts 34 and nuts 35 together with the flanges of the outer combustion chamber wall 29 and the inner combustion chamber wall 30 as well as the head plate 31. At that, the screw connection is realized in such a manner that the central axes of the threaded bolts extend in a radial plane which is oriented radially with respect to the engine axis 1. Thus, the flanges 41 to 46 respectively form cylindrical surfaces to facilitate a simple mounting and to avoid any leakages through small tolerances.

Figure 4:
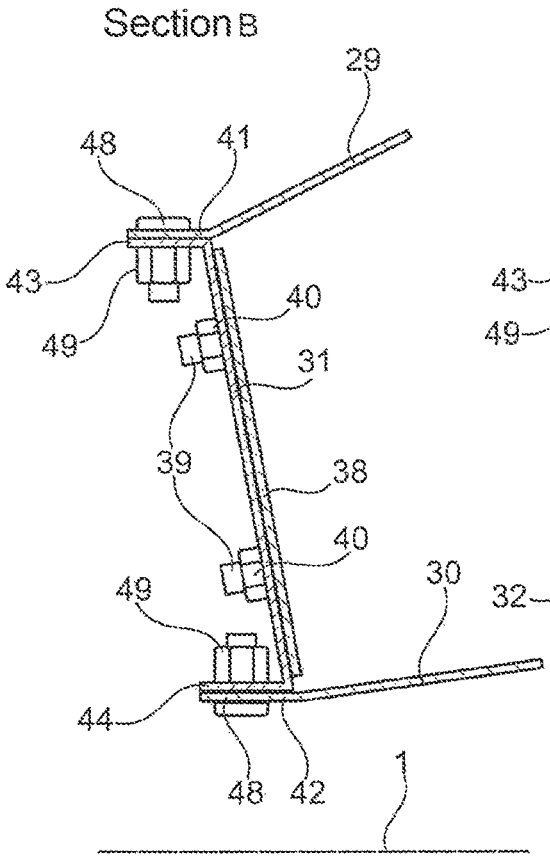
Figure 5:
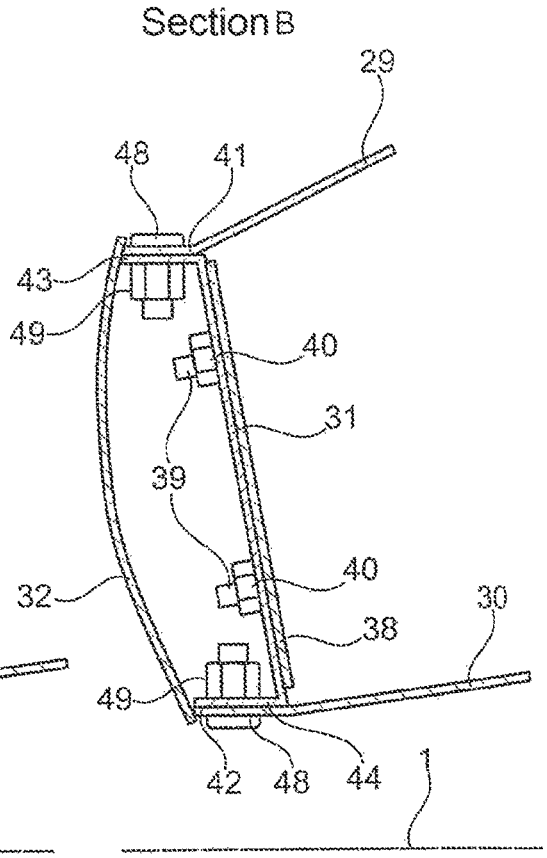

As shown in FIGS. 2, 4 and 5, heat shields 38 are mounted at the side of the head plate 31 that is facing towards the interior space of the combustion chamber. The number of the heat shields is usually identical with the number of the fuel nozzles (not shown). The heat shields 38 are screwed on by means of threaded bolts 39 and nuts 40. The heat shields are screwed together with the head plate 31 before the latter is mounted.

In accordance with section A of FIG. 3, FIG. 2 thus shows a completely mounted state with a plurality of threaded bolts 34 and nuts 35 being arranged around the circumference. The nuts 35 are screwed on through assembly openings of the combustion chamber head 32, which are not shown.

FIG. 3 shows a top view in which a partial area of the outer combustion chamber wall 29 is shown. What results in the mounted state is a top view perspective onto the outer flange 45 of the combustion chamber head 32.

As follows from the section B according to FIG. 3, the flange 45 of the combustion chamber head 32 has recesses 47 distributed around the circumference. They serve for mounting purposes, as will be described in the following in connection to FIGS. 4 and 5.

FIGS. 4 and 5 respectively show sections B according to FIG. 3. At that, in FIG. 4 the combustion chamber head 32 is not yet mounted. FIG. 4 shows that the mounting is realized by first using threaded bolts 48 and nuts 49 to connect the flanges 41 and 42 of the outer 29 and the inner 30 combustion chamber wall to each other at the circumference in the areas in which the outer flange 45 or the inner flange 46 of the combustion chamber head are provided with the recess 47. The connection is realized so as to be able to align and position the combustion chamber walls 29 and 30 as well as the head plate 31 with respect to one other. At the circumference, some of the recesses 47 are provided at the combustion chamber head 32. The number of the threaded bolts 48 or nuts 49 to be used results from the number of recesses 47.

As shown in FIG. 5, the combustion chamber head 32 is subsequently slid on, wherein the recesses 47 are positioned in such a manner that they correspond to the threaded bolt 48 or the nuts 49. Here, it is necessary to manufacture the combustion chamber head 32 in a very precise manner and to position it so as to avoid any collision with the threaded bolts 48 during mounting.

Subsequently, the outer and inner flanges 45, 46 of the combustion chamber head 32 are screwed together with the flanges 41 to 44 of the combustion chamber walls 29, 30 and the head plate 31.

What results is a very work-intensive mounting process that must be performed with high precision. Another considerable disadvantage is the fact that it is necessary to provide a plurality of recesses 47 at the flanges 45 and 46 of the combustion chamber head 32 in a circumferentially distributed manner. This leads to some production-technical effort, entailing additional costs.

The invention is based on the objective to create a method of the kind that has been mentioned above, which facilitates an operationally safe mounting of the combustion chamber while also having a simple structure and being easy and cost-effective to realize.

The objective is achieved by a combination of features as disclosed herein. The present disclosure also shows further advantageous embodiments.

It is thus provided according to the invention that the head plate is connected to the outer combustion chamber wall and the inner combustion chamber wall by means of rivets that are distributed around the circumference. Thus, the rivets serve for ensuring temporary mounting in a simple and quick manner. Unlike in the state of the art, there is no need for additional screw connections, which have to be mounted and secured. Instead, the rivets themselves are sufficient to ensure a pre-assembly of the outer and the inner combustion chamber wall and of the combustion chamber head. After pre-assembly and connection by means of the rivets, the combustion chamber head is brought in position and connected in the customary manner to the pre-mounted arrangement of outer combustion chamber wall, inner combustion chamber wall and head plate by means of threaded bolts and nuts. At that, a customary screw connection may be used, which serves for tensioning the individual flanges of the combustion chamber walls, the head plate and the combustion chamber head in an operationally safe manner. This can be performed in a usual manner through assembly openings in the combustion chamber head.

According to the invention, it is thus not necessary to provide recesses or notches at the combustion chamber head or at its flanges, which—just like in the state of the art—serve for omitting or avoiding bolted connections by means of which the combustion chamber walls and the head plate are initially pre-assembled.

According to the invention it is thus possible to mount the four main groups of the structural components of a combustion chamber of a gas turbine engine, namely an outer and an inner combustion chamber wall, a head plate as well as a combustion chamber head in a precisely-fitting and effective manner. At that, a pre-assembly of the head plate and the inner and outer combustion chamber walls is realized by means of rivets. In this way, a stable arrangement is present before the combustion chamber head is screwed to the pre-assembled assembly group. A precise connection can be achieved by providing the rivet connection between the inner and the outer combustion chamber wall and the head plate, wherein the structural components are in particular not exposed to thermal loads, which for example occurs during welding procedures. Moreover, a rivet connection is more simple and more durable than a screw connection, which in addition may entail errors with respect to the toque that has to be provided, and moreover increases the total weight of the combustion chamber. In contrast to a welded connection, the provision of a rivet connection leads to a lasting connection without having an adverse effect on the metallurgical environment, as would be the case if a welding method was used. Besides, the rivet connection makes it possible to avoid any thermal warping of the structural components, as it may occur as a result of a welded connection. According to the invention it is thus possible to provide, in a targeted manner, a combustion chamber which can be mounted in a simple and cost-effective way and which in addition facilitates a weight reduction due to the fact that the rivet connections have a considerably lower weight than screw connections, which is achieved through the combination of providing rivet connections for a pre-assembled assembly group and the final screwing process of the combustion chamber head. Apart from that, the rivet connections also lead to advantages with respect to production-technical aspects.

It is particularly advantageous if, prior to mounting, the outer combustion chamber wall, the inner combustion chamber wall and the head plate are provided with a plurality of rivet recesses that are arranged in a circumferentially distributed manner and are aligned with each other in the mounted state. These rivet recesses can be configured in a slightly different manner than the recesses for passing the threaded bolts. Thus, it is for example possible to provide the rivet recesses with a smaller diameter, since the rivets necessary for pre-assembly do not have to have the same diameter as the threaded bolts.

According to the invention, the rivet recesses can be configured as circular holes or also as elongated holes. In this manner, matching, pre-assembly and/or alignment of the outer combustion chamber wall, the inner combustion chamber wall and the head plate is facilitated in a simple manner. For example, the rivet recesses can be provided with a counterbore for inserting countersunk-head rivets, with their heads not protruding from the outer circumferential surface of the flanges of the combustion chamber walls and/or of the head plate.

In a particularly advantageous embodiment of the invention it is provided that a rivet connection for the purpose of pre-assembly is only realized at some of the rivet recesses that are provided at the circumference. Thus, it is for example possible to provide only three rivet connections that are arranged around the circumference in an evenly distributed manner, for example at a distance of 120°. Here, the other rivet recesses remain unused. This has the advantage that, in the event of a disassembly, the rivets used for pre-assembly can be drilled out to facilitate the disassembly of the outer and the inner combustion chamber wall as well as the head plate. For re-mounting and for realizing a rivet connection as a part of this procedure, some of the remaining rivet recesses can be used. Thus, for the purpose of pre-assembly, rivet connections are realized at least in three positions at the circumference according to the invention. The number of these rivet connections also depends on the stability of the outer and the inner combustion chamber wall and of the head plate as well as on the dimensioning of the combustion chamber.

Thus, as part of the method according to the invention, the rivet recesses provided according to the invention are inserted in addition to the recesses by means of which the combustion chamber head is screwed on in the completely mounted state. Here, it can be particularly advantageous if these screw recesses and rivet recesses are inserted in an alternating manner.

According to the invention, the combustion chamber head is preferably provided with a plurality of screw recesses that are arranged at the outer and the inner flange of the combustion chamber head. These screw recesses are arranged and dimensioned in such a manner that they align with the screw recesses of the combustion chamber walls and the head plate, so that the customary screw connection may be carried out when the combustion chamber head is slid on.

Figure 6:
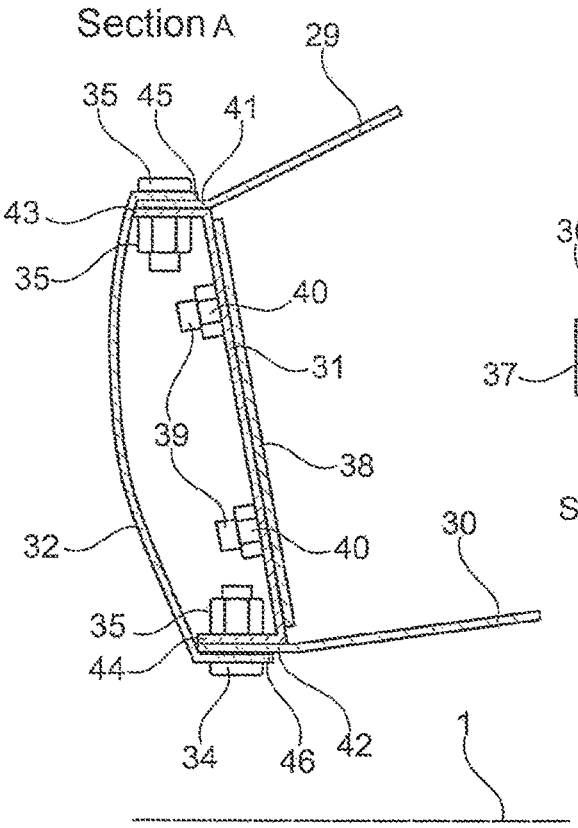
Figure 7:
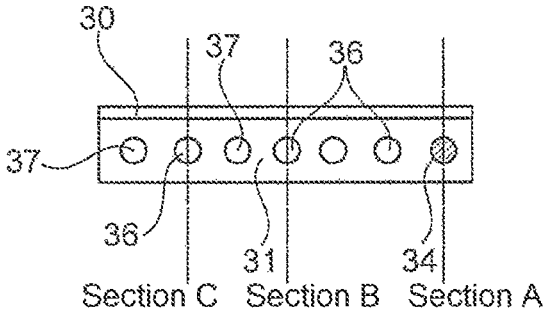
Figure 8:
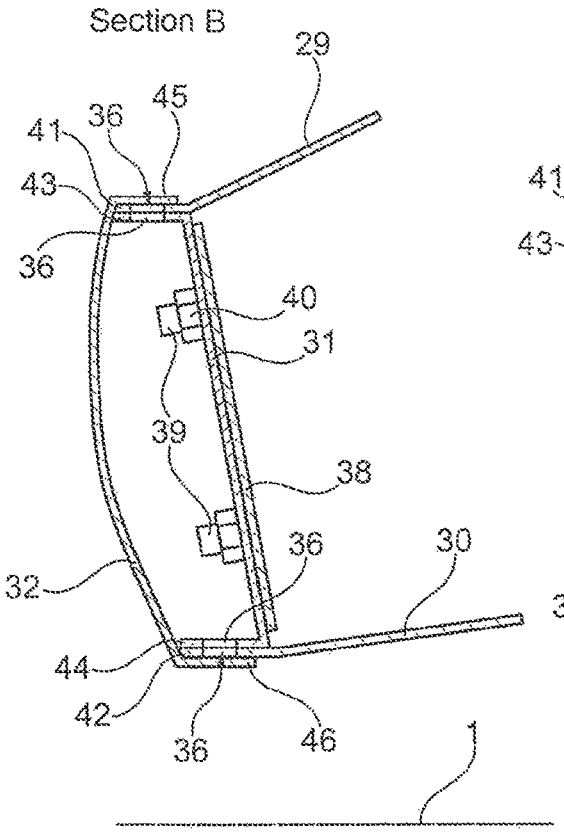
Figure 9:
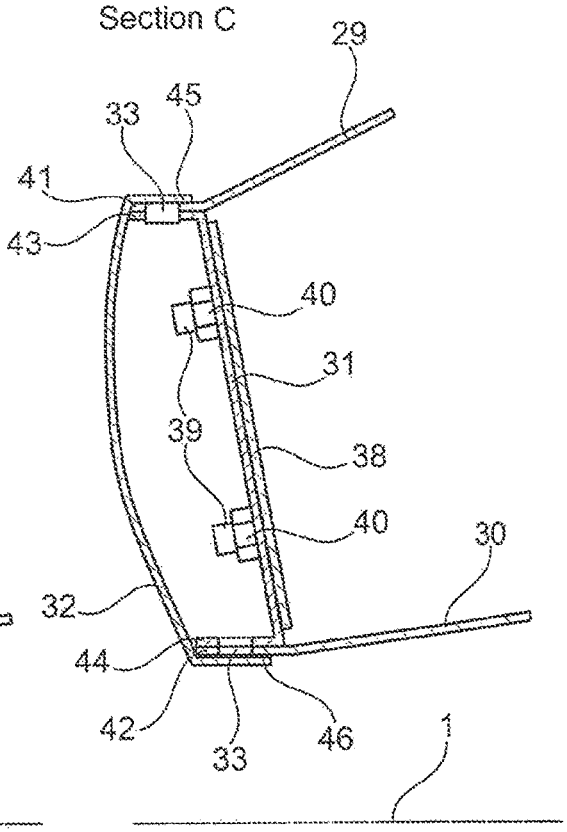

In the following, the invention is described based on an exemplary embodiment in connection with the drawing. Herein:

FIG. 1 shows a schematic rendering of a gas turbine engine according to the present invention, FIG. 2 shows a simplified sectional view of a front area of a completely mounted combustion chamber according to the state of the art, FIG. 3 shows a top view of the arrangement according to FIG. 2, which corresponds to section A, FIG. 4 shows a simplified sectional view according to section B of FIG. 3 in the pre-assembled state according to the state of the art, FIG. 5 shows a sectional view in the completely mounted state according to section B of FIG. 3 according to the state of the art, FIG. 6 shows a simplified sectional view, analogous to FIG. 5, of an exemplary embodiment according to the invention according to section A of FIG. 7, FIG. 7 shows a bottom view of the flange area of the arrangement according to FIG. 6, FIG. 8 shows a sectional view according to section B of FIG. 7, and FIG. 9 shows a sectional view according to section C of FIG. 7.

In the following exemplary embodiments, identical parts like those in FIGS. 2 to 5 are provided with the same reference numbers, so that it is not necessary to repeat the detailed description.

The gas turbine engine 10 according to FIG. 1 represents a general example of a turbomachine in which the invention may be used. The engine 10 is configured in a conventional manner and comprises, arranged successively in flow direction, an air inlet 11, a fan 12 that rotates inside a housing, a medium-pressure compressor 13, a high-pressure compressor 14, a combustion chamber 15, a high-pressure turbine 16, a medium-pressure turbine 17 and a low-pressure turbine 18 as well as an exhaust nozzle 19, which are all arranged around a central engine axis 1.

The medium-pressure compressor 13 and the high-pressure compressor 14 respectively comprise multiple stages, of which each has an arrangement of fixedly arranged stationary guide vanes 20 that extend in the circumferential direction and are generally referred to as stator vanes and which project radially inward from the core engine shroud 21 through the compressors 13, 14 into a ring-shaped flow channel. Further, the compressors have an arrangement of compressor rotor blades 22 that project radially outward from a rotatable drum or disc 26, and which are coupled to hubs 27 of the high-pressure turbine 16 or the medium-pressure turbine 17.

The turbine sections 16, 17, 18 have similar stages, comprising an arrangement of stationary guide vanes 23 projecting radially inward from the housing 21 through the turbines 16, 17, 18 into the ring-shaped flow channel 31, and a subsequent arrangement of turbine blades/vanes 24 projecting outwards from the rotatable hub 27. During operation, the compressor drum or compressor disc 26 and the blades 22 arranged thereon as well as the turbine rotor hub 27 and the turbine rotor blades/vanes 24 arranged thereon rotate around the engine axis 1.

FIG. 6 shows, in the sectional view A according to FIG. 7, a completely mounted state, in which the outer flange 45 and the inner flange 46 of the combustion chamber head 32 as well as the flanges 41 and 42 of the outer combustion chamber wall 29 or the inner combustion chamber wall 30 and the outer flange 43 and the inner flange 44 of the head plate 31 are screwed together by means of the threaded bolts 34 and the nuts 35. Additionally, FIG. 6 shows that the head plate 31 is screwed together with at least one heat shield 38 by means of threaded bolts 39 and nuts 40.

FIG. 8 shows the sectional view B of the mounted state according to FIG. 6. However, the sectional view of FIG. 8 is arranged around the circumference in an offset manner. While the section A runs through the central axes of the threaded bolts 34, the section according to FIG. 8 (section B) runs through the central axes of the rivet recesses 36, which are embodied with screw recesses 37 alternating at the circumference, as shown in FIG. 7. In the sectional view according to FIG. 8, it is shown that the rivet recesses 36 extend through the flange 41 of the outer combustion chamber wall 29 and the outer flange 43 of the head plate 31, or through the inner flange 44 of the head plate 31 and the inner flange 42 of the inner combustion chamber 30. In the shown section, these rivet recesses 36 are not occupied, since only a small number of rivet connections is used around the circumference for pre-assembly, while the rest of the rivet recesses 36 remain unused, as has been mentioned above. FIG. 8 shows that the outer flange 45 and the inner flange 46 of the combustion chamber head 32 are slid over the flanges 41 or 42 to be screwed on in positions that are circumferentially offset, as shown in FIG. 6.

FIG. 9 shows a section C according to FIG. 7. As can be seen here, the outer flange 41 of the outer combustion chamber wall 29 and the outer flange 43 of the head plate 31 are connected by means of a rivet 33 for the purpose of pre-assembly. In the same way, the inner flange 44 of the head plate 31 and the flange 42 of the inner combustion chamber wall 30 are connected by means of a rivet 33 for the purpose of pre-assembly. Subsequently, for the final assembly, the combustion chamber head 32 can be slid over the rivet 33 with its ring flanges 45 and 46, as shown in FIG. 9. Since the rivets 33 are embodied as countersunk-head rivets, they do not interfere during the further mounting, and in particular do not interfere when the flanges 45,46 of the combustion chamber head 32 are slid on.

PART LIST

1 engine axis
10 gas turbine engine/core engine
11 air inlet
12 fan
13 medium-pressure compressor (compactor)
14 high-pressure compressor
15 combustion chamber
16 high-pressure turbine
17 medium-pressure turbine
18 low-pressure turbine
19 exhaust nozzle
20 guide vanes
21 core engine housing
22 compressor rotor blades
23 guide vanes
24 turbine rotor blades
25 bypass channel
26 compressor drum or compressor disc
27 turbine rotor hub
28 outlet cone
29 outer combustion chamber wall
30 inner combustion chamber wall
31 head plate
32 combustion chamber head
33 rivet
34 threaded bolt
35 nut
36 rivet recess
37 screw recess
38 heat shield
39 threaded bolt
40 nut
41 outer flange
42 inner flange
43 outer flange
44 inner flange
45 outer flange
46 inner flange
47 recess
48 threaded bolt
49 nut

The invention claimed is:

1. A method for mounting a combustion chamber of a gas turbine engine, comprising:

positioning an annular outer combustion chamber wall and an annular inner combustion chamber wall with respect to one another, pre-assembling the annular outer combustion chamber wall and the annular inner combustion chamber wall to a head plate with a plurality of riveted connections circumferentially distributed around the head plate to provide an assembly including the annular outer combustion chamber wall, the annular inner combustion chamber wall, the assembly having an outer circumferential surface, wherein the plurality of riveted connections include a plurality of rivets and a plurality of aligned rivet recesses distributed circumferentially around the outer circumferential surface for receiving the plurality of rivets;

providing the plurality of rivets as countersunk-head rivets such that surfaces of the plurality of rivets that face an inner circumferential surface of a combustion chamber head do not protrude from the outer circumferential surface, subsequently positioning the combustion chamber head over the riveted connections such that 1) the inner circumferential surface is positioned over the surfaces of the plurality of rivets that face the inner circumferential surface and 2) the inner circumferential surface engages the outer circumferential surface, and then mounting the combustion chamber head to the assembly with a plurality of threaded fasteners.

2. The method according to claim 1, and further comprising providing that the plurality of aligned rivet recesses are configured as at least one chosen from circular holes and elongated holes.

3. The method according to claim 1, and further comprising providing the plurality of riveted connections at only some of the plurality of aligned rivet recesses.

4. The method according to claim 1, and further comprising providing that the plurality of rivets are evenly circumferentially distributed around the head plate.

5. The method according to claim 1, and further comprising providing, prior to mounting of the head plate, that a heat shield is mounted to the head plate by threaded bolts and nuts.

6. The method according to claim 1, and further comprising providing that at least one chosen from the outer combustion chamber wall, the inner combustion chamber wall, the head plate and the combustion chamber head is made of a sheet metal material.

7. The method according to claim 1, wherein the plurality of threaded fasteners includes a plurality of nuts and bolts.

8. The method according to claim 1, and further comprising:

providing the combustion chamber head with a plurality of screw recesses, providing that the outer combustion chamber wall, the inner combustion chamber wall and the head plate with a plurality of screw recesses, and providing that the plurality of screw recesses of the combustion chamber head are aligned with the plurality of screw recesses of the outer combustion chamber wall, the inner combustion chamber wall and the head plate in the mounted state of the combustion chamber head.

9. The method according to claim 8, and further comprising providing that the screw recesses and rivet recesses are circumferentially distributed around the head plate in an alternating manner.

* * * * *